US005370139A

United States Patent [19]

Shu et al.

[11] Patent Number: 5,370,139

[45] Date of Patent: Dec. 6, 1994

[54] TOBACCO TREATMENT PROCESS

[75] Inventors: Chi-Kuen Shu, Pfafftown; Brian M. Lawrence, Winston-Salem; Joyce R. Durham, Winston-Salem; Dwo Lynm, Winston-Salem, all of N.C.

[73] Assignee: R. J. Reynolds Tobacco Company, Winston-Salem, N.C.

[21] Appl. No.: 137,241

[22] Filed: Oct. 14, 1993

[51] Int. Cl.[5] ..... A24B 15/00

[52] U.S. Cl. ..... 131/274; 131/364

[58] Field of Search ..... 131/360, 290, 352, 364, 131/274–279, 298, 359

[56] References Cited

U.S. PATENT DOCUMENTS

| | | | |
|---|---|---|---|
| 3,769,040 | 10/1973 | Pittet et al. | 131/278 X |
| 4,010,286 | 3/1977 | Hall et al. | 131/277 X |
| 4,284,824 | 8/1981 | Klemarczyk et al. | 131/276 X |
| 4,348,416 | 9/1982 | Boden | 131/276 X |
| 4,379,464 | 4/1983 | Wu et al. | 131/275 |
| 4,428,387 | 1/1984 | Mookherjee et al. | 131/276 |
| 4,430,354 | 2/1984 | Boden et al. | 131/276 X |
| 4,446,125 | 5/1984 | Mookherjee et al. | 131/276 X |
| 5,074,319 | 12/1991 | White et al. | 131/298 |
| 5,105,836 | 4/1992 | Gentry et al. | 131/359 |
| 5,129,408 | 7/1992 | Jakob et al. | 131/372 X |
| 5,234,008 | 8/1993 | Fagg | 131/297 |
| 5,261,425 | 11/1993 | Raker et al. | 131/336 X |
| 5,271,419 | 12/1993 | Arzonico et al. | 131/336 X |

OTHER PUBLICATIONS

Leffingwell et al., *Tobacco Flavoring For Smoking Products*, pp. 1–10 and 38–43, Aug. 1972.

*Primary Examiner*—Jennifer Bahr

[57] ABSTRACT

A process is provided for treating tobacco material for use in a smoking article comprising the step of applying a flavorful and aromatic casing and top dressing composition comprising a weak ammonium salt and a sugar or sugar derivative to a tobacco material. The present also provides a smoking article including tobacco material wherein the tobacco material is in intimate contact with a casing and top casing composition comprising a weak ammonium salt and a sugar or sugar derivative.

14 Claims, No Drawings

TOBACCO TREATMENT PROCESS

BACKGROUND OF THE INVENTION

The present invention relates to providing a flavorful and aromatic additive. Such additive is applied as a casing or top coating to a tobacco material.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material.

Cigarettes are employed by the smoker by burning one end thereof. The smoker then receives mainstream smoke into his/her mouth by drawing on the opposite end (e.g., filter end) of the cigarette. Typically, a person using a cigarette draws on or puffs the article about 5 to about 10 times, and each puff lasts about 0.5 second to about 2 seconds. Typically, a burning cigarette has a useful lifetime of about 1 minute to about 10 minutes. Various types of tobaccos and other materials can be blended to form the cut filler of a cigarette. Generally, various amounts of flue-cured, Burley, Maryland and Oriental tobaccos are blended together and ultimately form cut filler. A typical blend also can include reconstituted tobacco material, volume expanded processed tobacco, cut rolled stems, tobacco substitutes, and other such materials. The cut filler frequently is treated with volatile additives such as top dressing or flavors in the form of an alcoholic solution. See, for example, British Pat. No. 910,451 to Davis and U.S. Pat. No. 4,819,668 to Shelar et al.

In addition to the volatile "top flavor" additives, another category of additives having a relatively low degree of volatility is also customarily applied to tobacco. This category includes materials such as sugars, licorice, cocoa, essential oils, fruit extracts and humectant. These materials are known in the art as "casing" materials and they are applied to the tobacco by dipping or spraying prior to the cutting or shredding operation.

There has been interest in other additives based on amino acids or sugars. For example, U.S. Pat. No. Re. 32,095 to Wu et al. proposes reacting sugars with ammonium hydroxide in the presence of a trace amount of an amino acid to provide flavorants suitable for use in smoking articles.

It would be highly desirable to provide flavorful and aromatic casing and top dressing compound which compliment the flavor and aroma characteristics of smokable materials.

SUMMARY OF THE INVENTION

A process for treating tobacco material for use in a smoking article comprising the step of applying a flavorful and aromatic casing and top dressing composition comprising a weak ammonium salt and a sugar or sugar derivative to a tobacco material is provided. The present invention also provides a smoking article including tobacco material wherein the tobacco material is in intimate contact with a casing and top casing composition comprising a weak ammonium salt and a sugar or sugar derivative. Exemplary sugars include fructose, glucose, galactose, sucrose, rhamnose, maltose, xylose, and mannose. As used herein, the term "weak ammonium salt" relates to ammonium salts formed from acids having a low ionization constant and a small disassociation constant. The weak acids readily release ammonia during heating as compared to strong acids. Suitable weak ammonium salts include ammonium phosphate, diammonium phosphate, ammonium bicarbonate, ammonium carbonate, ammonium citrate, diammonium citrate, ammonium levulinate, ammonium alginate, ammonium monocarboxylic acids and ammonium dicarboxylic acids.

The aromatic and flavorful casing and top dressing composition is applied so as to be in intimate contact with the smoking material (e.g., the cut filler). The aromatic and flavorful casing and top dressing composition is used in an amount sufficient to provide an alteration in flavor and aroma of the smoking material of the cigarette upon burning during use.

The present invention allows the smoker to enjoy good tobacco taste upon smoking the smoking article (e.g., a cigarette). In particular, the aroma provided by the chemical rearrangement of the flavorful and aromatic casing and top dressing composition during the use of the smoking article can be such so as to override the odor of the ensuing sidestream smoke, and thereby suppress the odor thereof. In particular, the taste of the mainstream smoke is complemented or not adversely affected by the compounds provided by the rearrangement of the aromatic and flavorful precursor. For example, the flavor characteristics provided to the mainstream smoke by the aromatic and flavorful compounds are not so overpowering so as to deleteriously affect or otherwise provide undesirable off-tastes to the mainstream smoke.

DETAILED DESCRIPTION OF THE INVENTION

As summarized above, the process of the present invention includes applying a flavorful and aromatic casing and top dressing composition comprising a weak ammonium salt and a sugar to a smokable material. The weak ammonium salts typically have a low ionization constant and a small disassociation constant.

Examples of suitable sugars are fructose, glucose, galactose, sucrose, rhamnose, maltose, xylose, and mannose, and other monosaccharides and disaccharides, or the sugar derivatives such as $\alpha$-dicarbonyl compounds and $\alpha$-hydroxy carbonyl compounds. As used herein, the term "sugar derivative" relates to the fact that sugars undergo degradation via a rearrangement mechanism to form $\alpha$-dicarbonyl compounds such as 2,3-pentanedione, 2,3-butanedione, 3,4-hexanedione, 2,3-hexanedione, etc. or to form $\alpha$-hydroxy carbonyl compounds such as acetol, acetoin, 2-hydroxy-3-pentanone, 4-hydroxy-3-hexanone, etc. Thus, a sugar derivative can be the resulting $\alpha$-dicarbonyl compound or $\alpha$-hydroxy carbonyl compound or can be a compound that forms an $\alpha$-dicarbonyl or $\alpha$-hydroxy carbonyl after degradation.

The amount of the aromatic and flavorful casing and top coating composition employed can vary. The amount in intimate contact with the tobacco material (e.g., cut filler) ranges from 0.1 mg to about 25 mg per cigarette, and frequently about 0.15 to about 5 mg cigarette.

The smokable material employed in the manufacture of the smokable rod can vary, the most preferably has the form of cut filler. As used herein, the term "cut filler" in referring to smokable materials is meant to include smokable materials which have a form suitable for use in the manufacture of smokable rods for smoking articles such as cigarettes. As such, cut filler can include smokable materials which are blended and are in a form ready for cigarette manufacture. Smokable materials normally are employed in the form of strands or shreds as in common in cigarette manufacture. For example, cut filler can be employed in the form of strands or shreds cut from sheet-like or "strip" materials. Such strip materials are cut into widths ranging from about 1/5 inch to about 1/60 inch, preferably from about 1/25 inch to about 1/35 inch. Generally, the resulting strands or shreds have lengths which range from about 0.25 inch to about 3 inches. Cut filler also can have an extruded form (e.g., extruded strands), or other physically processed form.

The coated tobacco cut filler having the casing and top dressing composition in contact therewith may be combined with aerosol forming materials, and employed in the manufacture of those smoking articles described in U.S. Pat. Nos. 4,708,151 to Shelar; 4,771,795 to White et al.; 4,714,082 to Banerjee et al.; 4,756,318 to Clearman et al.; and 4,793,365 to Sensabaugh et al., the disclosures of which are incorporated herein by reference, as well as European Patent Publication Nos. 212,234 and 277,519. In addition, the coated tobacco cut filler can be incorporated into those smoking articles described in commonly assigned U.S. Pat. application Ser. No. 07/414,833 filed Sep. 29, 1989 and European Patent Publication No. 280,990.

Upon experiencing the temperatures of a burning smoking article, the flavorful and aromatic casing and top casing composition undergoes a change in the chemical nature to form a plurality of compounds that as a whole provide a characteristic flavor and aroma. Conditions provided during the burning of a smoking article most desirably are such that the ammonium salt and sugars undergo Maillard reactions or "browning reactions". See Maillard, *Ana. Chim.*, Vol. 9, pp. 5 and 258 (1916); Hodge, *J. Agric Food Chem.*, Vol. 1, p. 928 (1953); Nursten, *Food Chem.*, Vol. 6, p. 263 (1981) and Waller et al., *ACS Symp. Ser.* (1983). Such reactions result in a significant darkening of the mixture. Additionally, flavoring agents (e.g., cocoa, licorice, St. John's bread, spices, herbs, and the like) can be added to the mixture to further enhance the flavor and aromatic characteristics of the resulting composition.

The following examples are provided in order to further illustrate preferred aspects of the invention but should not be construed as limiting the scope thereof. Unless otherwise noted, all parts and percentages are by weight.

EXAMPLE 1

Five pounds of Burley tobacco are charged into a tumbling drum, and are sprayed with a solution of diammonium phosphate (81 grams), glucose (220 grams) and water (750 ml). The tobacco is placed into an oven (Sargeant Dryer), and heated between 310° to 320° F. for 2.5 min and 2 min of updraft and downdraft respectively. The moisture of the tobacco is adjusted to 12.1 percent with water prior to cigarette making.

Another five pounds of Burley tobacco is also treated under the same conditions as the control sample except that no diammonium phosphate and glucose were added. A comparison between the aroma of the test tobacco and the control tobacco revealed that the test tobacco possessed strong pleasant notes including sweet, roasted, chocolate-like, fruity notes with a rounded tobacco aroma.

Both the control cigarettes and the test cigarettes were smoked by an expert panel and the panel agreed that the test cigarettes were preferred, the test cigarettes were described as possessing a well rounded, smooth, sweet, toasted, cocoa/chocolate-like character.

EXAMPLE 2

The procedure of Example 1 is repeated except that 137 grams of diammonium citrate is used. The test tobacco also showed aroma characteristics superior to the control tobacco.

EXAMPLE 3

The procedure of Example 1 is repeated except that 96 grams of ammonium bicarbonate is used. The test tobacco also showed aroma characteristics superior to the control tobacco.

That which is claimed is:

1. A process for treating tobacco material for use in a smoking article comprising the step of applying a flavorful and aromatic casing and top casing composition comprising a weak ammonium salt and a sugar or sugar derivative to a tobacco material.

2. The process according to claim 1 wherein the weak ammonium salt is selected from the group consisting of ammonium phosphate, diammonium phosphate, ammonium bicarbonate, ammonium carbonate, ammonium citrate, diammonium citrate, ammonium levulinate, ammonium alginate, and salts of ammonium monocarboxylic acids and ammonium dicarboxylic acids.

3. The process according to claim 1 whereby the casing and top casing composition comprises a sugar is selected from the group consisting of fructose, glucose, galactose, sucrose, rhamnose, maltose, xylose and mannose.

4. The process according to claim 1 whereby the amount of the casing and top dressing composition is from about 0.1 mg to 25 mg per smoking article.

5. The process according to claim 1 whereby the casing and top casing composition comprises a sugar derivative which is an $\alpha$-dicarbonyl or $\alpha$-hydroxy carbonyl compound.

6. The process according to claim 5 whereby the $\alpha$-dicarbonyl compound is 2,3-pentanedione, 2,3-butanedione, 3,4-hexanedione or 2,3 hexanedione.

7. The process according to claim 5 wherein the $\alpha$-hydroxy carbonyl compound is acetol, acetoin, 2-hydroxy-3-pentanone or 4-hydroxy-3-hexanone.

8. A smoking article including tobacco material wherein the tobacco material is in intimate contact with a casing and top casing composition comprising a weak ammonium salt and a sugar or sugar derivative.

9. The smoking article according to claim 8 wherein the weak ammonium salt is selected from the group consisting of ammonium phosphate, diammonium phosphate, ammonium bicarbonate, ammonium carbonate, ammonium citrate, diammonium citrate, ammonium levulinate, ammonium alginate, and salts of ammonium monocarboxylic acids and ammonium dicarboxylic acids.

10. The smoking article according to claim 8 wherein the casing and top casing composition comprises a sugar which is selected from the group consisting of fructose, glucose, galactose, sucrose, rhamnose, maltose, xylose and mannose.

11. The smoking article according to claim 8 wherein the amount of the casing and top dressing composition is from about 0.1 mg to 25 mg per smoking article.

12. The smoking article according to claim 8 wherein the casing and top casing composition comprises a sugar derivative which is an α-dicarbonyl or α-hydroxy carbonyl compound.

13. The smoking article according to claim 12 whereby the α-dicarbonyl compound is 2,3-pentanedione, 2,3-butanedione, 3,4-hexanedione or 2,3-hexanedione.

14. The smoking article according to claim 12 wherein the α-hydroxy carbonyl compound is acetol, acetoin, 2-hydroxy-3-pentanone or 4-hydroxy-3-hexanone.

* * * * *